US007294980B2

(12) United States Patent
Ma et al.

(10) Patent No.: US 7,294,980 B2
(45) Date of Patent: Nov. 13, 2007

(54) FAN CONTROL SYSTEM

(75) Inventors: Wen-Churn Ma, Taoyuan Hsien (TW); Venson Kuo, Taoyuan Hsien (TW); Wen-Shi Huang, Taoyuan Hsien (TW)

(73) Assignee: Delta Electronics, Inc., Taoyuan Sien (TW)

( * ) Notice: Subject to any disclaimer, the term of this patent is extended or adjusted under 35 U.S.C. 154(b) by 0 days.

(21) Appl. No.: 11/492,890

(22) Filed: Jul. 26, 2006

(65) Prior Publication Data

US 2006/0261761 A1 Nov. 23, 2006

Related U.S. Application Data

(63) Continuation of application No. 10/923,861, filed on Aug. 24, 2004, now Pat. No. 7,135,826.

(30) Foreign Application Priority Data

Aug. 26, 2003 (TW) ..... 92123388 A

(51) Int. Cl.
*H02P 5/46* (2006.01)
*F04B 41/06* (2006.01)

(52) U.S. Cl. ..... 318/49; 318/77; 318/111

(58) Field of Classification Search ..... 318/34, 318/41, 49, 59, 66, 68, 77, 85, 93–95, 111–113, 318/471–473; 388/909, 934; 310/52, 58, 310/62–63

See application file for complete search history.

(56) References Cited

U.S. PATENT DOCUMENTS 4,289,997 A 9/1981 Jung et al.
4,465,956 A * 8/1984 Fowler ..... 318/268
4,504,751 A * 3/1985 Meier ..... 310/62
4,554,491 A * 11/1985 Plunkett ..... 318/254
4,618,806 A * 10/1986 Grouse ..... 318/254
4,668,898 A * 5/1987 Harms et al. ..... 318/254
4,702,154 A 10/1987 Dodson
4,797,600 A 1/1989 Savage et al.
5,099,181 A * 3/1992 Canon ..... 318/254
5,119,466 A * 6/1992 Suzuki ..... 388/831
5,672,943 A 9/1997 Vivers et al.
5,739,648 A 4/1998 Ellis et al.
5,949,646 A 9/1999 Lee et al.
6,141,213 A 10/2000 Antonuccio et al.
6,318,965 B1 11/2001 Nair
6,326,747 B1 12/2001 Shiba et al.
6,398,505 B1 6/2002 Sekiguchi et al.
6,501,648 B2 12/2002 Huang et al.
6,619,736 B2 * 9/2003 Stowe et al. ..... 297/180.14
6,725,132 B2 4/2004 Frankel et al.
6,750,562 B2 6/2004 Rolls et al.
6,814,546 B2 11/2004 Sekiguchi et al.
6,932,696 B2 8/2005 Schwartz et al.
6,950,969 B2 * 9/2005 Thompson et al. ..... 714/44

* cited by examiner

*Primary Examiner*—Bentsu Ro
(74) *Attorney, Agent, or Firm*—Birch, Stewart, Kolasch & Birch, LLP

(57) ABSTRACT

A fan control system. The system includes a plurality of fans, each having a control device. One of the fans is designated as a master fan and others are served as slave fans according to a specific designation method, wherein the control device of the master fan actively monitors and controls the operating state of the slave fans according to the control device of the slave fans to amend the operating state of all fans.

14 Claims, 5 Drawing Sheets

FAN CONTROL SYSTEM

This application is a Continuation of application Ser. No. 10/923,861 filed on Aug. 24, 2004, now U.S. Pat. No. 7,135,826, and for which priority is claimed under 35 U.S.C. § 120; and this application claims priority of Application No. 092123388 filed in Taiwan, Republic of China on Aug. 26, 2003 under 35 U.S.C. § 119; the entire contents of all are hereby incorporated by reference.

BACKGROUND OF THE INVENTION

1. Field of the Invention

The present invention relates to a fan control system and in particular to a fan control system controlling a plurality of fans.

2. Description of the Related Art

In general, device fans normally run when a power is supplied. The power can turn the fan on or off but the power cannot provide other control functions which are provided by a coupled controller such as multiple operating speeds controller. FIG. 1 is a schematic view of a conventional fan control system. Controller 10 is coupled to and controls fans 12*a*~12*n* in a parallel fashion, such that flexibility of the fan control system is reduced.

Additionally, the controller 10 can only control a limited number of fans and the number of controllers increase with the number of fans or output signals thereof, such that costs of the fan control system increase.

FIG. 2 is a block diagram of a fan as disclosed in U.S. Pat. No. 6,318,965. The CPU 62 of the exemplary host machine 50 is also shown to have a memory 66 and a connection via the system bus 64 to a storage subsystem 68. The fan 52 comprises a controller 56, a temperature sensor 74, and a fan motor 76. The temperature sensor 74 senses a temperature and sends a temperature signal to the controller 56, the controller 56 alter the rpm of the fan motor 76 according to the temperature signal.

If the temperature sensor 74 is not included within the fan 52, the host machine 50 dynamically passes temperature data to the fan 52 via system bus 64. The controller 56 alters the rpm of the fan motor 76 according to the passed temperature data.

Although the controller 56 alters the rpm of the fan motor 76 according to the temperature signal sent by the temperature sensor 74 or the temperature data passed by the host machine 50, the controller 56 does not monitor and amend fan 54.

FIG. 3 is an electronic system as disclosed in U.S. Pat. No. 6,725,132. Each cooling fan 242, 244, 246, and 248 has a microcontroller to detect failures of other cooling fans 242, 244, 246, and 248. Although each cooling fan 242, 244, 246, and 248 has the ability to detect and compensate for other failed fans by increasing its fan speed, each cooling fan 242, 244, 246, and 248 cannot directly control fan speed of the other fans. Therefore, cooling fan 242, 244, 246, and 248 still only are controlled by user system 140 and power source 210.

SUMMARY OF THE INVENTION

It is therefore an object of the present invention to provide a fan control system with increasing system flexibility.

The fan control system comprises a plurality of fans each having a control device. The control devices of fans designate one fan as a master fan and the others as slave fans according to a specific designation method. The control device of the master fan actively analyzes operating states of all fans to control the operating states of those fans.

All fans also can monitor each. When the master fan is breakdown, the control devices of the slave fans can re-designate a new master fan. For example, the specific designation method designates the new master fan according to access addresses of all control devices. The control device of the master fan also can amend deviant behavior of the slave fans.

A fan control system comprising at least one control fan and at least one fan. The fan connects with the control fan, wherein an operating state of the fan is controlled by the control fan, and the control fan communicates with the fan by a data communicating.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present application will become more fully understood from the subsequent detailed description and the accompanying drawings, which are given by way of illustration only , and thus are not limitative of the present invention, and wherein.

DETAILED DESCRIPTION OF THE INVENTION

Figure 1:
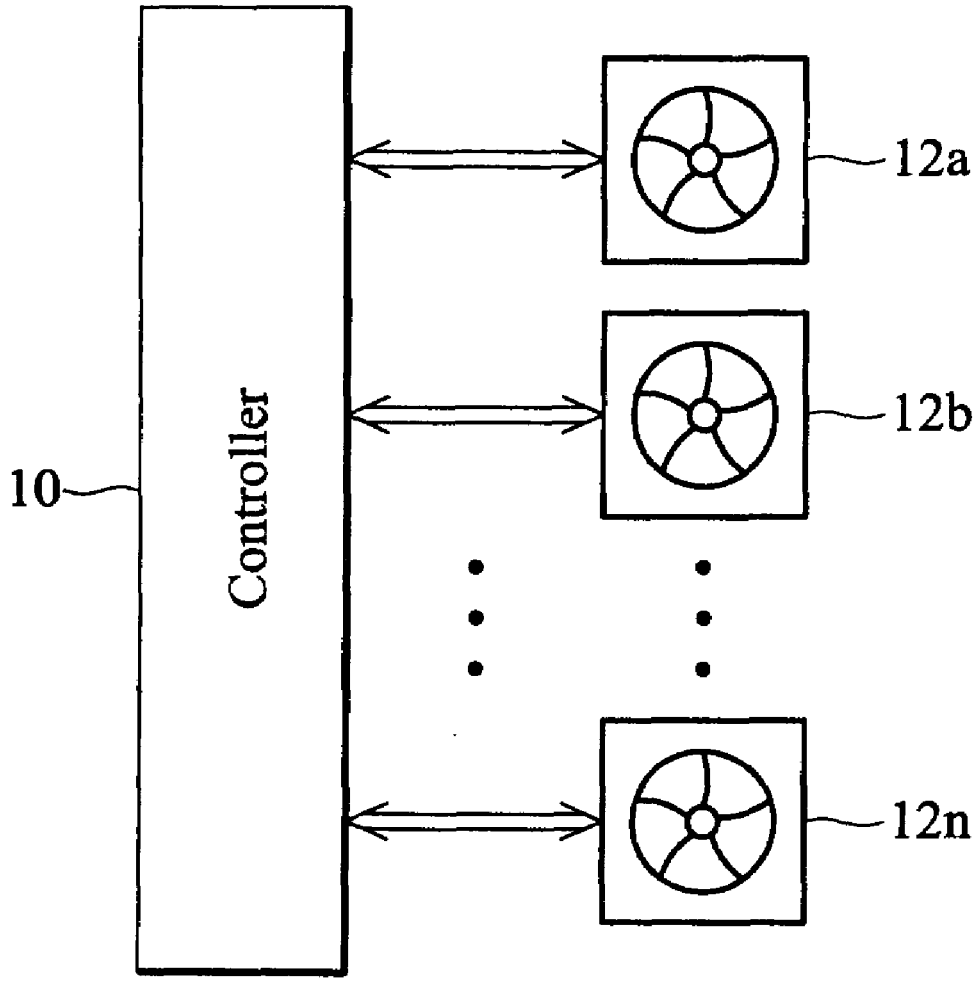
FIG. 1 (RELATED ART)
FIG. 1 is a schematic view of a conventional fan control system.
Figure 2:
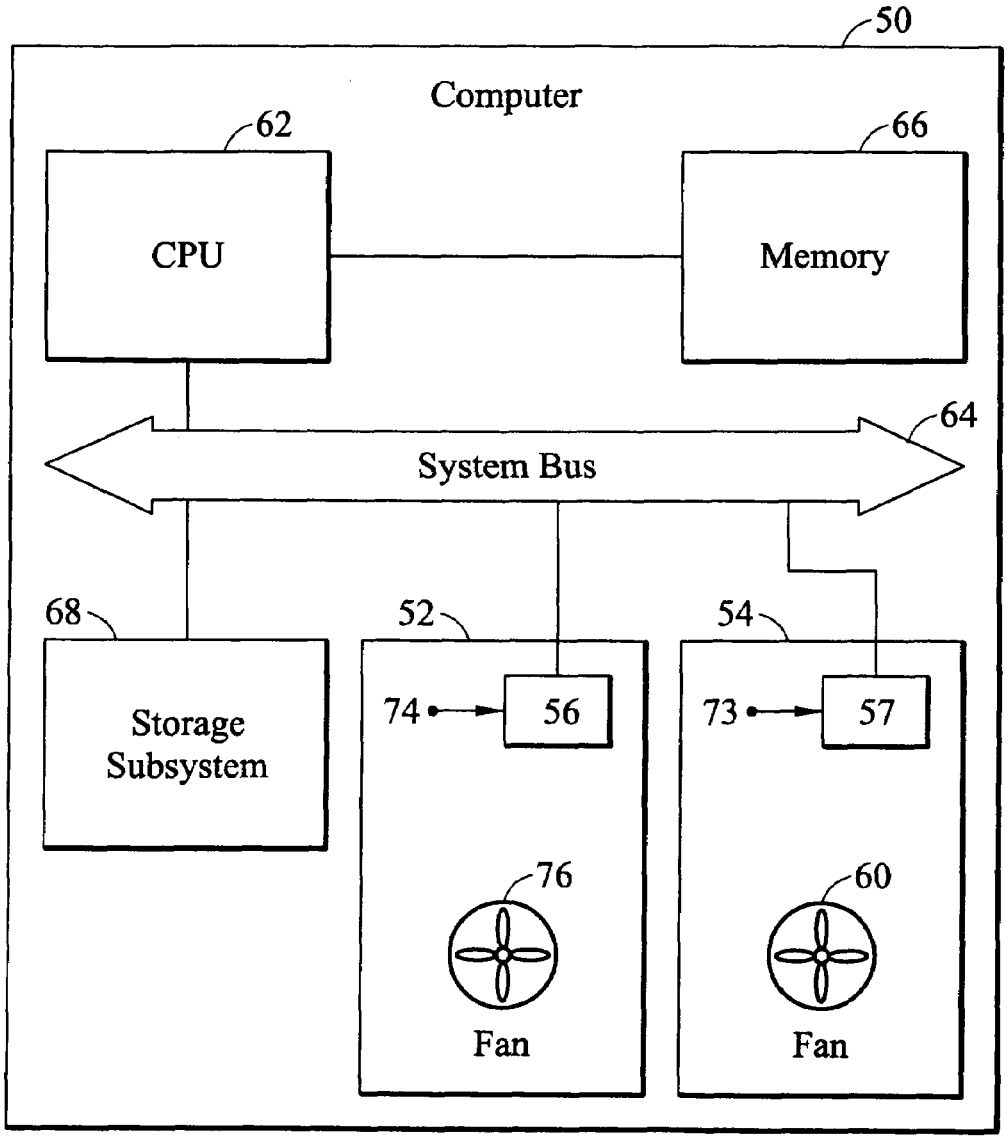
FIG. 2 (RELATED ART)
FIG. 2 is a block diagram of a fan as disclosed in U.S. Pat. No. 6,318,965.
Figure 3:
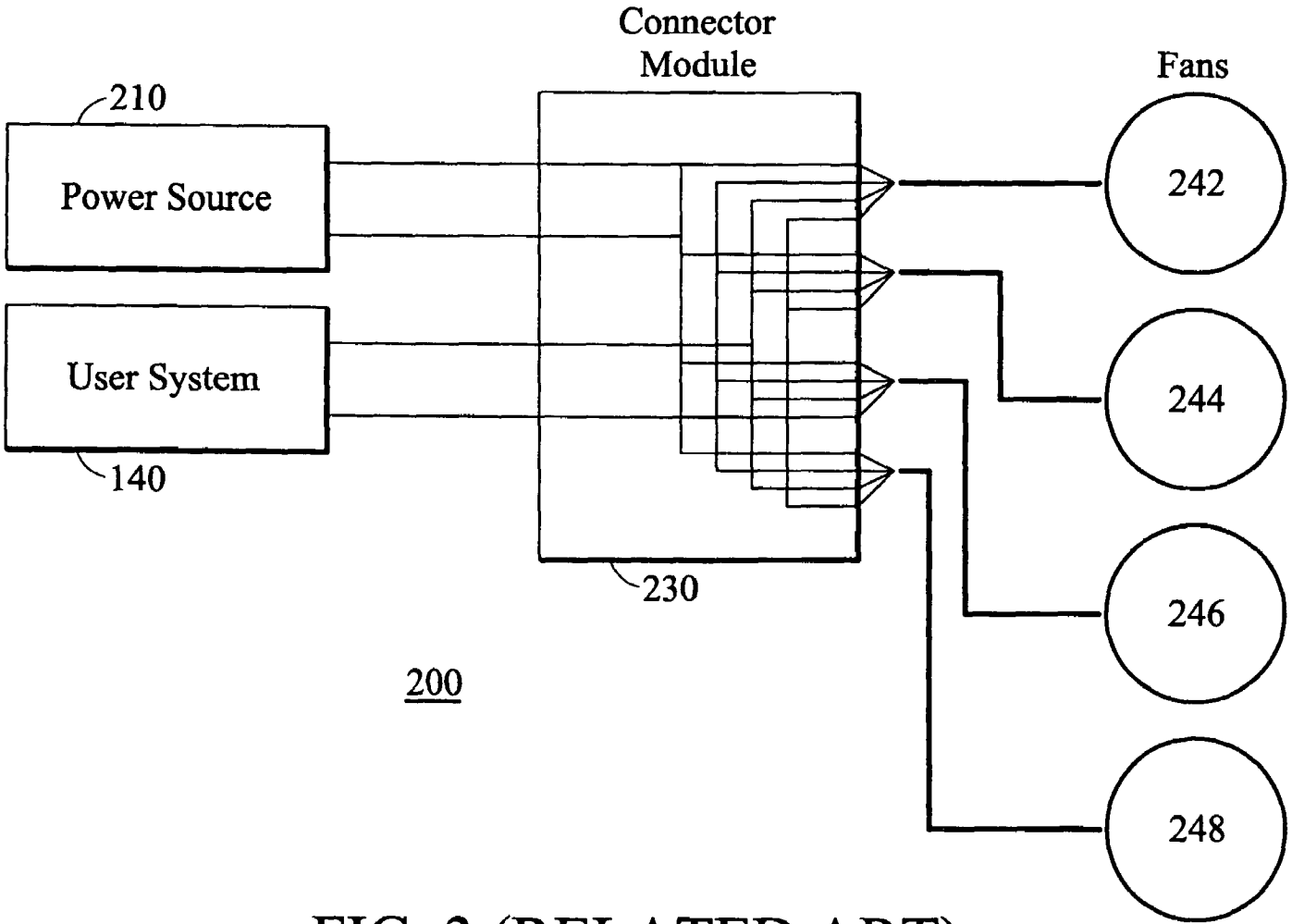
FIG. 3 (RELATED ART)
FIG. 3 is an electronic system as disclosed in U.S. Pat. No. 6,725,132.
Figure 4:
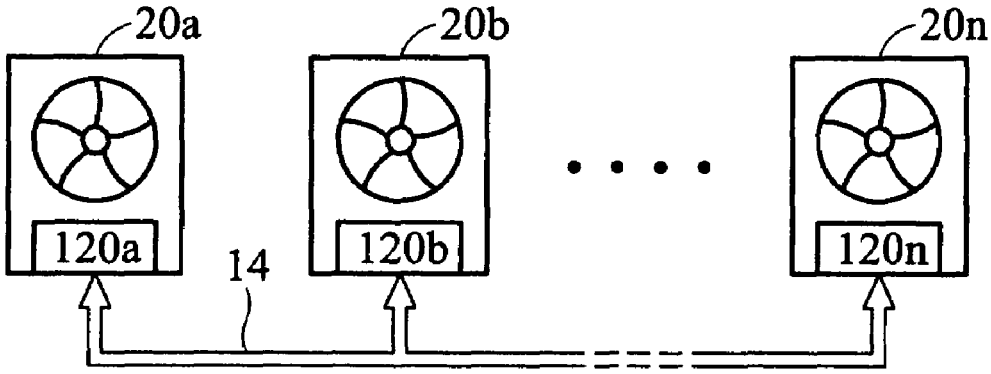
FIG. 4 is a block diagram of a fan control system of the present invention.

FIG. 4 is a block diagram of a fan control system of the present invention. The fan control system of the present invention comprises at least one master and slave fans with the following description disclosing a fan control system comprises a master fan and a plurality of salve fans for clarity.

The fan control system comprises a master fan 20*a*, slave fans 20*b*~20*n*, and a connection device 14. The master fan 20*a* has a control device 120*a* monitoring and controlling its operating state. Each slave fans 20*b*~20*n* has a control device 120*b*~120*n* monitoring and controlling the operating states thereof. The control devices of fans designate one fan as a master fan and the others as slave fans according to a specific designation method. The connection device 14 connects the control devices 120*a*~120*n* and utilizes a specific communication method for transmitting a data. The control devices 120*a*~120*n* will transmit the data to each other or an external device (not shown) through the connection device 14. In this embodiment, the connection device 14 is a bus and utilizes a handshake protocol.

The control device 120*a* utilizes bus to connect control devices 120*b*~120*n* for actively monitoring the operating state of fans 20*a*~20*n*. The control device 120*a* changes the operating state of fans 20*a*~20*n* according to operating state of fans 20*a*~20*n*. The master fan 20*a* issues a warning signal for informing users when the slave fans 20*b*~20*n* is abnormal.

Figure 5:
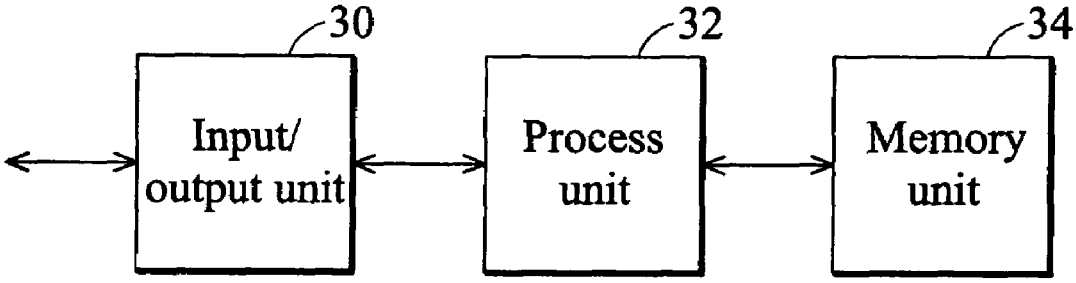
FIG. 5 is an internal block diagram of the control device.

FIG. 5 is an internal block diagram of a control device. Each has an input/output unit 30, a process unit 32, and a memory unit 34. The input/output unit 30 transmits data to or receives data from other fans. The process unit 32 amends the operating state of the corresponding fan according to a signal output from the input/output unit 30. The memory unit 34 records the monitored operating state of fans, such as, run state or actuated count. For example, each the control device 120*a*~120*n* comprises a single chip processor and each has an access address, respectively.

In the fan control system, one fan is designated as a master and the others as slave fans according to the specific designation method. The designation method is well known to those skilled in the field. Two specific designation methods are described in the following.

One specific designation method designates the master and slave fans according the wait time of each fan. Taking FIG. 4 as an example, the fan control system comprises fans 20*a*~20*n*. The wait time of the fan 20*a* is 1 unit time, the wait time of the fan 20*b* is 2 unit time, and so on. Since the wait time of the fan 20*a* is less than the wait time of other fans, the fan 20*a* is designated as a master fan.

When the master fan 20*a* is not providing a control signal within a specific time, each of the fans 20*b*~20*n* simultaneously outputs a requirement signal. But the output requirement signals will conflict. Thus, each of the fans 20*b*~20*n* again and respectively outputs the requirement signal. The wait time of the fan 20*b* is less than the wait time of other fans 20*c*~20*n*, such that the fan 20*b* first outputs the requirement signal. Since the fans 20*c*~20*n* are receiving the requirement signal output from the fan 20*b*, the fan 20*b* is designated as a new master fan.

Another method designates the master and slave fans according to an access address. A fan control comprises fans 20*a*~20*n* shown in FIG. 4. Each fan comprises a control device having an access address. If the access address of the fan 20*a* is 01, the access address of the fan 20*b* is 02, and so on. Since the access address of the fan 20*a* is less than other fans 20*b*~20*n*, the fan 20*a* is designated as a master fan. When the fan 20*a* is failed, the fan 20*b* is designated as a new master fan due to access address of the fan 20*b* is less than other fans 20*c*~20*n*.

In this embodiment, the fan control system designates the master fan according to an access address. The control device 120*a* actively monitors the operating states of the slave fans 20*b*~20*n* via the control device 120*b*~120*n* and amends the operating states according to the priority set by control devices 120*b*~120*n*. The control device 120*a* records selected from the group consisting of the running time of the fans 20*a*~20*n*, power failure counts of the fans 20*a*~20*n*, the operating state of the fans 20*a*~20*n*, and combinations thereof.

Control device 120*a* actively adjusts the operating states of fans 20*a*~20*n* to maintain a desired heat-dissipation effect when the operating state of one or more fans does not achieve a predetermined range. When one slave fan 20*b*~20*n* is deviant, the master fan 20*a* amends other slave fans 20*b*~20*n* or the deviant fan to solve the deviant and issues a warning signal to notify an external device (not shown). If the abnormal slave fan continues to deviate, the master fan 20*a* continues to solve the deviant and to issue the warning signal.

The master fan 20*a* is detected as having failed when the control devices 120*b*~120*n* do not receive signal output from the control device 120*a* within a specific time. The control devices 120*b*~120*n* designate a new master fan from among slave fans 20*b*~20*n* to assure heat-dissipation duties. The new master fan issues a warning signal representing that the old master fan 20*a* is failed.

Figure 6:
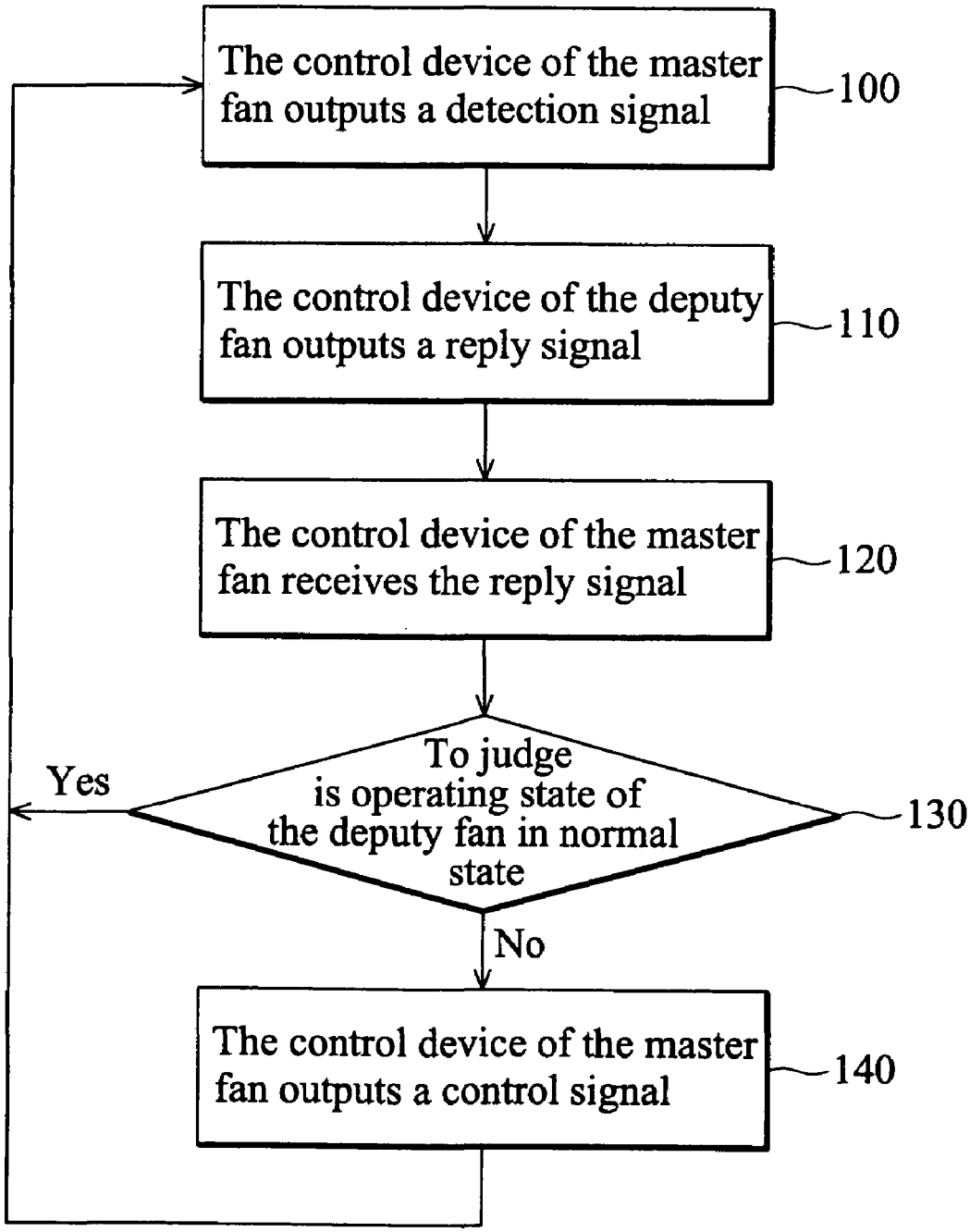
FIG. 6 shows a control method of the present invention.

FIG. 6 shows a control method of the present invention. Please refer to FIGS. 4 and 6. In this example, fan 20*a* is the master fan and fans 20*b*~20*n* are slave fans. Fans 20*a*~20*n* are arranged in sequence of priority.

The control method comprises the following steps.

In step 100, control device 120*a* outputs a detection signal to slave fan 20*b*. In step 110, control device 120*b* outputs a reply signal, such as its running speed, to the control device 120*a*, and, in step 120 control device 120*a* receives the reply signal. In step 130, control device 120*a* monitors the operating state of slave fan 20*b* according to the reply signal. If the operating state of slave fan 20*b* is normal, step 100 is carried out for the next slave fan. Otherwise, step 140 is carried out. In step 140, control device 120*a* outputs a control signal to amend operating states of fans 20*a*~20*n* to maintain function of the fan control system.

For example, if control device 120*a* actively monitors the running speed of fans 20*b*~20*n*, first it detects the fan 20*b* that has the highest priority among fans 20*b*~20*n*. When the control device 120*b* receiving the detecting signal from control device 120*a*, the control device 120*b* monitors the speed of fan 20*b* and outputs a reply to control device 120*a*, which determines whether the speed of the fan 20*b* is normal or not. If the speed of the fan 20*b* is below a preset speed, the control device 120*a* increases the speed of fan 20*b*. If the speed of fan 20*b* cannot be increased, control device 120*a* increases the speed of other fan. Then, the control device 120*a* handles the next fan.

In order to maintain stable operations the fan control system, the control device 120*a* can increases or reduce the speed of fans 20*a*~20*n* according to the speed and/or the temperature of fans 20*a*~20*n*. Therefore, the fan control system has better flexibility.

The control device 120*a* also monitors base data of slave fans 20*b*~20*n* such as the number of production or the parameter of slave fans 20*b*~20*n*. Thereby, the control device 120*a* can monitor the duty time of fans 20*a*~20*n*. The control 120*a* also can monitor the power state of fans 20*a*~20*n* to determine that is abnormal or normal.

In the fan control system, the master fan comprises a control device actively monitoring operating states of all fans and governs operating states thereof, increasing functional flexibility of the system.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed:

1. A fan control system comprising:

at least one master fan, each comprising a control device; and at least one slave fan, each comprising a control device and connecting with the master fan, wherein an operating state of the slave fan is controlled by the control device of the master fan, and the master fan and the slave fan are communicated with each other via a data signal and the operating state of the slave fan is adjusted by the master fan according to the data signal.

2. The fan control system as claimed in claim 1, wherein the master fan controls the master fan and the slave fan to turn on or off.

3. The fan control system as claimed in claim 1, wherein when the master fan is failed, the slave fan is designated as a new master fan according to a specific designation method.

4. The fan control system as claimed in claim 1, further comprising a connection device for connecting the master fan and the slave fan for transmitting the data therebetween.

5. The fan control system as claimed in claim 4, wherein the connection device is a bus connecting the master fan and the slave fan.

6. The fan control system as claimed in claim 1, wherein the master fan and the slave fan will transmit the data signal therebetween or to an external device.

7. The fan control system as claimed in claim 1, wherein the operating state of the master fan and/or the slave fan comprises a running state, a temperature state or a power state.

8. The fan control system as claimed in claim 1, wherein when the master fan or the slave fan is failed, the master fan generates a warning signal to notify an external device.

9. The fan control system as claimed in claim 1, wherein when the operating state of the master fan or the slave fan does not achieve a predetermined range, the master fan will adjust the operating state of the master fan and/or the slave fan to maintain a desired heat dissipation effect forte fan control system.

10. The fan control system as claimed in claim 1, wherein the master fan or the slave fan comprises a microprocessor.

11. The fan control system as claimed in claim 1, wherein the master fan or the slave fan comprises a memory unit to record the operating state of the master fan or the slave fan.

12. The fan control system as claimed in claim 1, wherein the master fan records a running time, a power failure counts, or an operating state.

13. The fan control system as claimed in claim 1, wherein the data signal is transmitted according to a handshake protocol.

14. The fan control system as claimed in claim 1, wherein the master fan or the slave fan further comprises an input/output unit to receive/transmit data between the master fan and the slave fan.

* * * * *